US006543163B1

(12) United States Patent
Ginsberg

(10) Patent No.: US 6,543,163 B1
(45) Date of Patent: Apr. 8, 2003

(54) MIRROR DISPLAY

(76) Inventor: Peter William Ginsberg, 1520 Vala Cir., Las Vegas, NV (US) 89101-1679

( * ) Notice: Subject to any disclaimer, the term of this patent is extended or adjusted under 35 U.S.C. 154(b) by 0 days.

(21) Appl. No.: 10/009,935

(22) PCT Filed: May 5, 2000

(86) PCT No.: PCT/US00/12511

§ 371 (c)(1),
(2), (4) Date: Nov. 5, 2001

(87) PCT Pub. No.: WO00/67049

PCT Pub. Date: Nov. 9, 2000

Related U.S. Application Data

(60) Provisional application No. 60/132,875, filed on May 5, 1999.

(51) Int. Cl.[7] ..... G09F 13/12

(52) U.S. Cl. ..... 40/219; 40/564; 40/900

(58) Field of Search ..... 40/219, 564, 577, 40/579, 580, 900

(56) References Cited

U.S. PATENT DOCUMENTS 1,786,155 A * 12/1930 Farrell ..... 40/580
2,114,711 A * 4/1938 Horinstein ..... 40/219
2,211,571 A * 8/1940 Jonap ..... 40/577
2,221,889 A * 11/1940 White ..... 40/219
2,372,124 A * 3/1945 Schenkel ..... 40/577
2,524,294 A * 10/1950 Marsh ..... 40/552
3,205,598 A * 9/1965 Grosse ..... 40/436
4,246,713 A * 1/1981 Eckert ..... 40/437
4,263,737 A * 4/1981 Simon ..... 40/453
4,796,170 A * 1/1989 Pedersen et al. ..... 362/308
5,210,967 A * 5/1993 Brown ..... 40/219
5,237,766 A * 8/1993 Mikolay ..... 40/564
5,787,618 A * 8/1998 Mullis ..... 40/219
6,231,196 B1 * 5/2001 Mahachek ..... 359/838

* cited by examiner

*Primary Examiner*—William L. Miller
(74) *Attorney, Agent, or Firm*—Kenehan & Lambertsen, Ltd.; John C. Lambertsen

(57) ABSTRACT

An illuminating display is provided a reflective panel having a graphical image formed therein. A laser is used to precisely etch the graphics pattern in an optically active surface, such as a mirrored surface. The graphical image is then reproduced on a paper carrier, and then brought into precise registration behind the laser-etched image. Upon backlighting, such as in a light box, the graphical image projects from the surrounding mirrored (reflecting) surface.

9 Claims, 4 Drawing Sheets

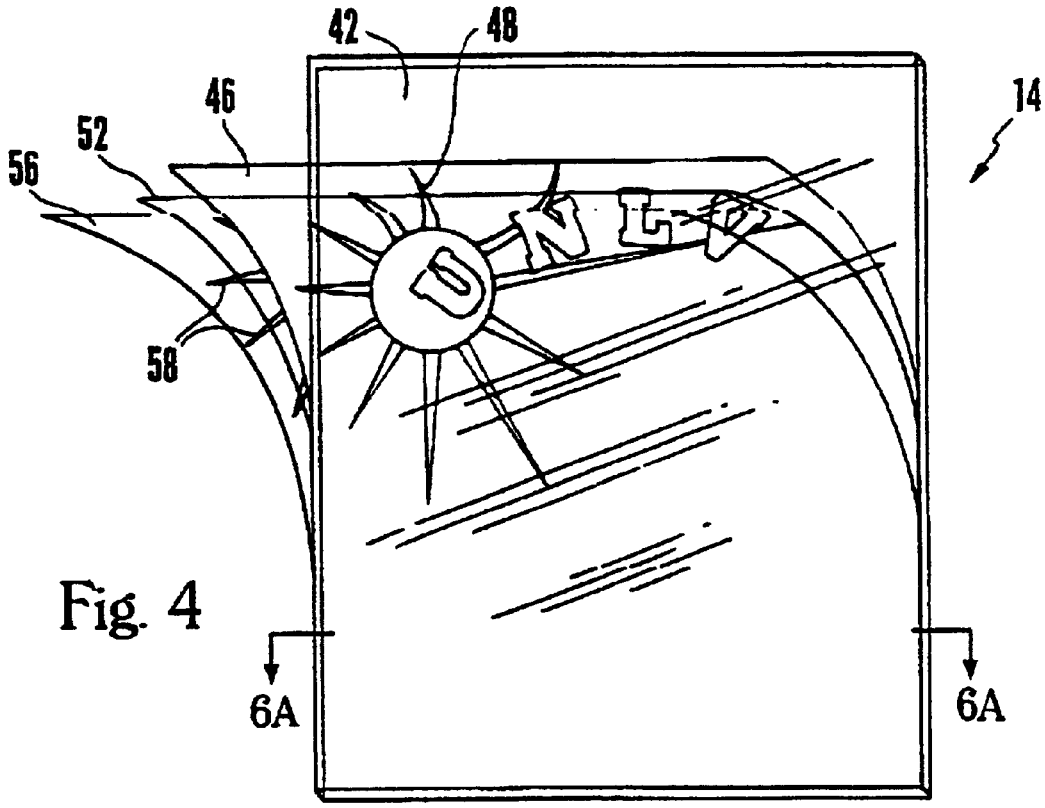
Fig. 4
Fig. 5
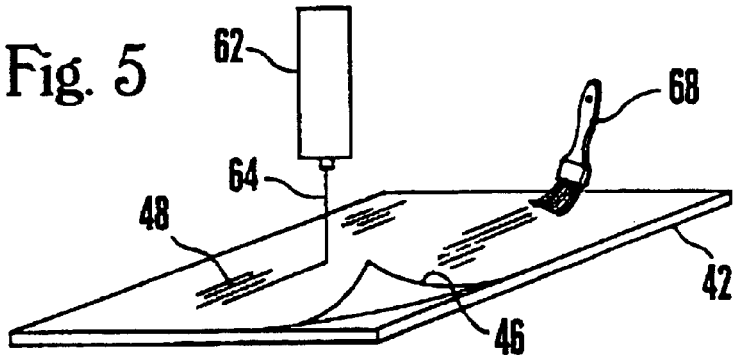
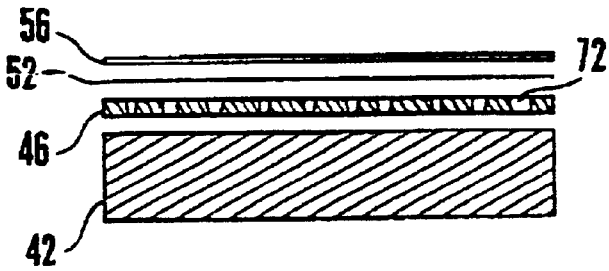
Fig. 6A

MIRROR DISPLAY

This application is a 371 of PCT/US00/12511, filed May 5, 2000, and a divisional of provisional application No. 60/132,875, filed May 5, 1999.

BACKGROUND OF THE INVENTION

1. Field of the Invention

The present invention relates to a mirror and light box assembly in which a light source within the box illuminates a mirrored image surface.

2. Description of the Prior Art

Mirrors, or reflective glass (plastic), have long been relied upon to provide decorative accents, their visual illusions widening and heightening space and intensifying lighting. They both provide a false sense of depth and cover actual wall defects. Mirrors also provide a surface shine that is seen to complement contemporary interiors.

Designers of commercial signage have not overlooked these same visual characteristics. In addition to a primarily decorative use in bars, advertising signs have long utilized mirrors and other reflective surfaces as a base upon which to paint slogans, logos, and product container designs. Technology and cost factors, unfortunately, have limited the previous application techniques to essentially only silk screening. As a result, the advertising slogans and symbols have been placed on the outside surface of the mirror. This surface placement tends to work against the illusion of depth that mirrors are otherwise able to create.

A need exists for advertising signage that utilizes the visual dynamics offered by mirrors, with the message, whether in words, symbols or both, are integrated into the mirrored sign in a manner that provides a visual impact complementing the dynamism of the mirror base.

SUMMARY OF THE INVENTION

It is an object of the present invention to provide a light box for use with a mirrored image surface that permits illumination of a detailed, colored image that is formed within or as part of the mirrored surface. In this regard, a laser-engraved image is formed in the mirrored or optical surface, and a matching graphic image placed on a carrier surface is overlaid in a manner that causes an exact registration between the two identical images.

The utilization of the same graphical information to control the laser engraving and the image reproduction makes possible such exact image registration. Additional adhesive and carrier layers can be used to bind the graphic image to the optical surface. The combined layers are then placed in a conventional light box. Without illumination from the light source, the mirrored surface reflects light in a conventional manner, and the colored graphical image is visible in those areas from which the reflective surface has been removed. Upon activation of the light source, the graphical image is illuminated from behind, causing an intensification of the image, which, when juxtaposed with the surrounding mirrored or reflective surface, tends to provide an enhanced, three-dimensional effect.

Some further objects and advantages of the present invention shall become apparent from the ensuing description and as illustrated in the accompanying drawings.

BRIEF DESCRIPTION OF THE DRAWINGS

FIG. 4 is a partially exploded perspective view showing each of the multiple layers making up a mirrored platform in accordance with the present invention;

FIG. 5 is a schematic depiction of a series of process steps used to form a mirrored platform in accordance with the present invention;

FIG. 6A is a cross-sectional view taken along line 6A—6A of FIG. 4, showing a mirrored platform in accordance with the present invention;

FIG. 9A is an enlarged view of the encircled area of FIG. 9, showing the area of interengagement between the light box and the image and protective layers in accordance with the present invention; and FIG. 9B is an enlarged view, similar to FIG. 9A, showing the protective overlay layer and image layer as received within a light box in accordance with the present invention.

DETAILED DESCRIPTION OF THE PREFERRED EMBODIMENTS

Figure 1:
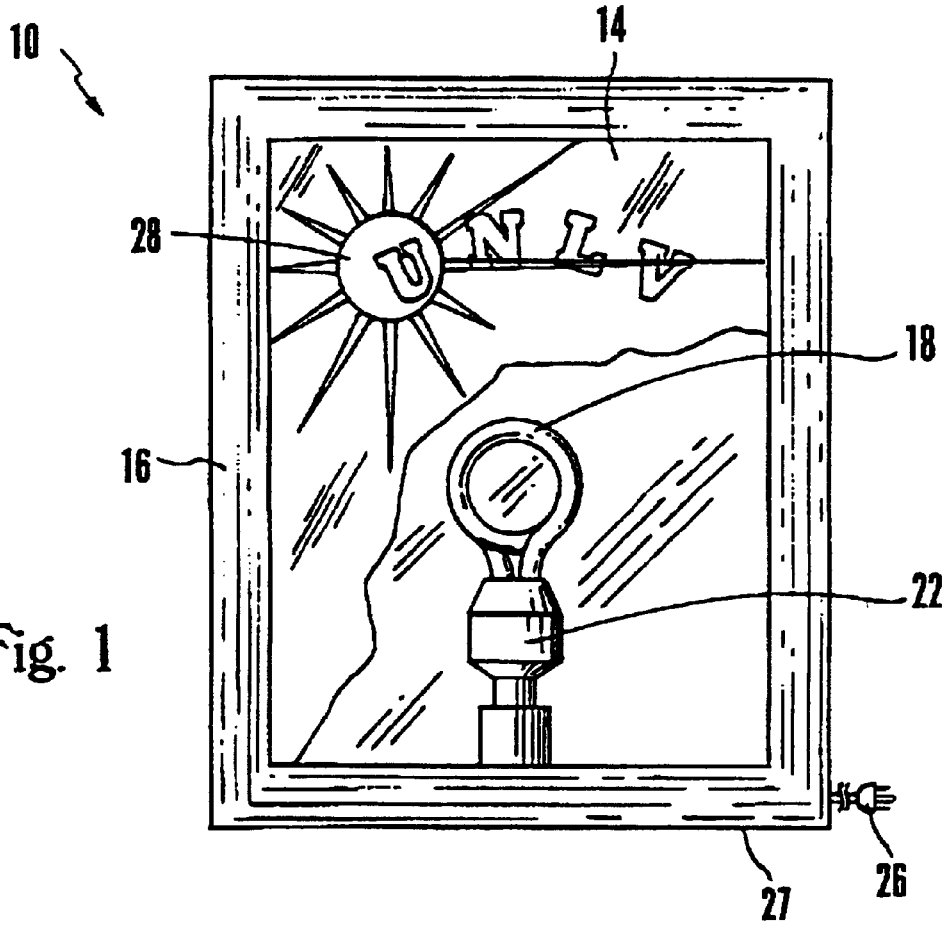
FIG. 1 is a top plan view, with portions broken away, showing a mirror display with internal lighting in accordance with the present invention.

Reference is now made to the drawings wherein like numerals refer to like parts throughout. An illuminated display 10 is shown in FIG. 1, having a reflective panel 14 received within an outer frame 16. The reflective panel 14 overlies a light source 18 that is received within a display housing 20. A light control circuit 22 is also located within the display housing and a power cord 26 is provided to connect the light source 18 to an external source of power (not shown in the Figures).

A power switch 27 that is preferably attached to, or accessible from, an outer surface of the illuminated display 10 controls application of power to the light source 18. Once energized, the light energy generated by the light source 18 within the display housing 20 is used to illuminate a work of graphic art 28 formed in the reflective panel 14.

Figure 2:
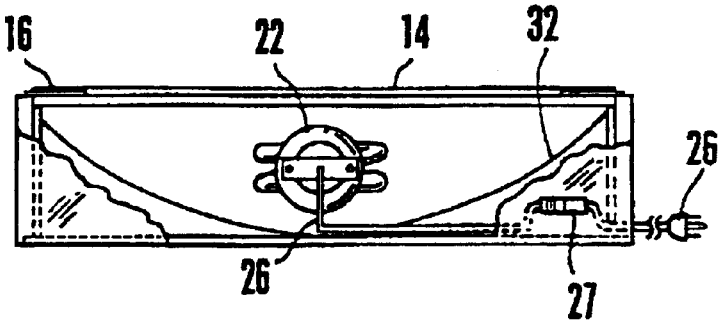
FIG. 2 is a first side elevation view, with portions broken away and portions in phantom, showing a base of a light source for internal use within a mirror display in accordance with the present invention.
Figure 3:
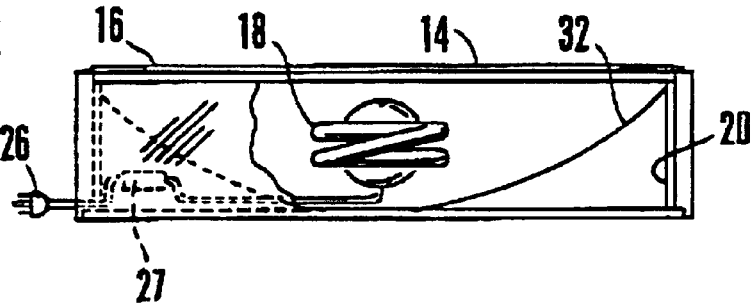
FIG. 3 is a second side elevation view, similar to FIG. 2, with portions broken away and portions in phantom, showing an upper portion of an illumination source within a mirror display in accordance with the present invention.

As is shown in FIGS. 2 and 3, a reflector 32 is preferably placed within the display housing 20 to enhance the focusing of light energy upon the reflective panel 14. The multiple-layered structure of the reflective panel 14 is best described with reference to FIG. 4.

The reflective panel 14 includes a primary or base layer 42 that can either be glass or, preferably, a clear acrylic material. A reflective layer 46 is formed on or is attached to the base layer 42, with both together forming the mirrored substrate used in the present invention.

A positive image 48 is inscribed in the reflective layer 46 by removal of reflective material. Thus, the positive image 48 comprises a transparent or non-reflective image formed within the reflective panel 14. To enhance the transparency of the reflective layer 46 at those locations where the reflective material has been removed, a clear coating layer 52 is applied to the reflective layer 46.

The construction of the reflective panel 14 is completed by the application of a graphics layer 56 over the clear coating layer 52. As is shown in FIG. 4, a graphics image 58 has been applied to a carrier, which is in turn attached to the reflective panel. It is also possible to apply a graphic directly to the clear coating layer 52 utilizing silkscreen or direct painting techniques.

Although the present invention can be fabricated using a number of different methods and techniques, FIG. 5 depicts a presently preferred process for creating the positive image 48. Since the image will ultimately be illuminated from behind by the light source 18 (not shown in FIG. 5), it is important that the positive image be sharply defined in the reflective layer 46. A laser unit 62 is depicted in FIG. 5 as generating a laser beam 64 to inscribe the positive image 48. Once completed, the clear coating layer 56 (not shown in FIG. 5) is applied using, by way of example and not of limitation, an application brush 68. It is to be understood and appreciated that, under a presently preferred embodiment, the clear coating layer would be applied by spraying.

Figure 6B:
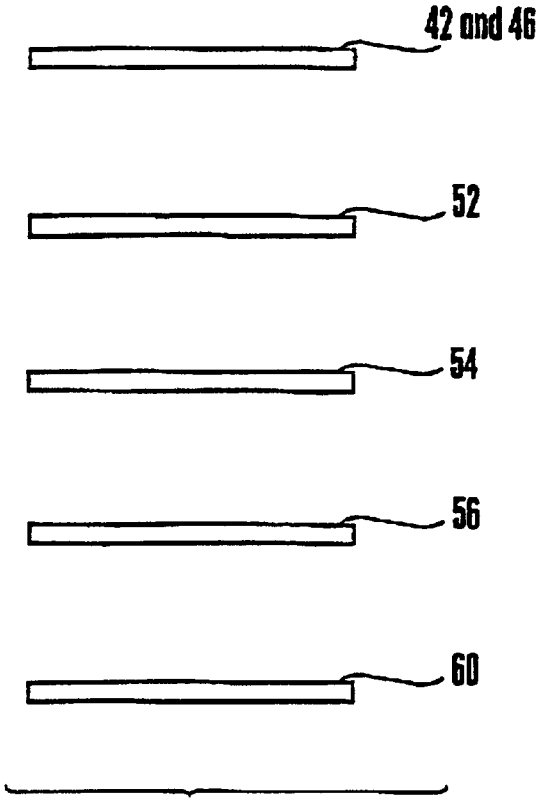
FIG. 6B is a cross-sectional view, similar to FIG. 6A, showing an alternative mirrored platform in accordance with the present invention.

The resulting, layered construction is depicted in FIG. 6A. The transparent base layer 42, which can be either glass or a clear acrylic, is made reflective by the reflective layer 46. A series of scoring marks 72 are formed in the reflective layer 46, and represent portions of the positive image 48 inscribed therein. The clear coating layer 52 is applied over the inscribed, reflective layer 46, with the clear coat material filling the scoring marks 72. The clear coat material interacts with the base layer 42 at the locations of the scoring marks 72 in a way that enhances the transparency of the positive image 48 relative to the base layer 42.

Finally, the graphics layer 56 is applied to the coating layer 52 to complete the reflective panel. In a preferred embodiment, an optically clear laminate 54 (see FIG. 6B) is used to secure the graphics layer 56 to the coated reflective layer. Presently, a double-release "Transparency Adhesive" sold by Coda of Mahwah, N.J., is preferred as the optical laminate 54.

Figure 6C:
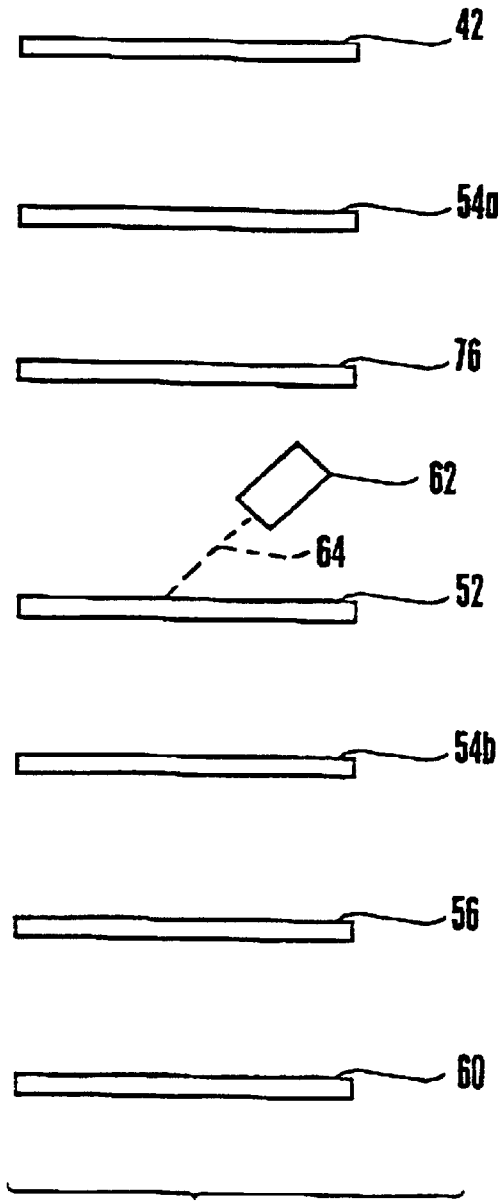
FIG. 6C is a cross-sectional view, similar to FIGS. 6A and 6B, showing a second alternative platform for use with a separate reflective layer of choice in accordance with the present invention.

The present invention can also be utilized with respect to other types of reflective or optically interesting surfaces. As is best discussed with reference to FIG. 6B, a material having an optically active surface 76 (including colored, holographic, and mirrored opaque films) can be attached to a clear base layer 42 using an optical laminate 54*a*. In this context, it is preferred that the laminate 54*a* be limited to include only the adhesive, and not an underlying carrier, such as a polyester liner, to limit potential optical imaging problems. After attachment to the clear base layer 42, as is illustrated in FIG. 6C, the layered construction is then subjected to the laser engraving operation to carve out an image in the optical surface 76. A second optical laminate layer 54*b* is then used to attach the graphics layer 56, and the protective laminate 60 completes the reflective imaging construction.

In a presently preferred embodiment, the graphics layer 56 takes the form of a paper carrier having a quasi-die sublimation image formed thereon using an ink jet printer (not shown in the Figures). Use of the laser unit 62 (see FIG. 5) enables the precise positioning of the image in the reflective layer 46, and the use of an ink jet printer does likewise with respect to the positioning of the graphical image on the paper carrier.

Since both are essentially controlled by digital information, it is possible to obtain virtually exact registration of the graphics image 58 on the graphics layer 56 and the positive image 48 formed in the reflective layer 46. In this manner, vibrant colors can be cost-effectively applied to a reflective panel using known and well-tested ink jet printing technology.

In a preferred embodiment, the illuminated display can be of varied dimensions, with 18" by 32" being a size having many commercial applications. When used in a home, a smaller size of 12" by 14" may be more appropriate. The outer frame 16 can be constructed out of a number of different materials, including wood, plastic and metal, with wood presently preferred based upon cost factors and ease of fabrication. By utilizing a fluorescent light as the light source 18, efficiencies are obtained that permit the depth of the illuminated display 10 to be minimized, with 2½" to 4" presently considered appropriate for uniform lighting of the image. For both small and large displays, multiple light sources are preferred to provide adequate light distribution. In the drawings, the reflector 32 is shown as enhancing such distribution. However, in a presently preferred embodiment, the use of a fluorescent light sources having their own reflective housings, instead of a separate reflector, considerably simplifies fabrication of the display unit.

Figure 7:
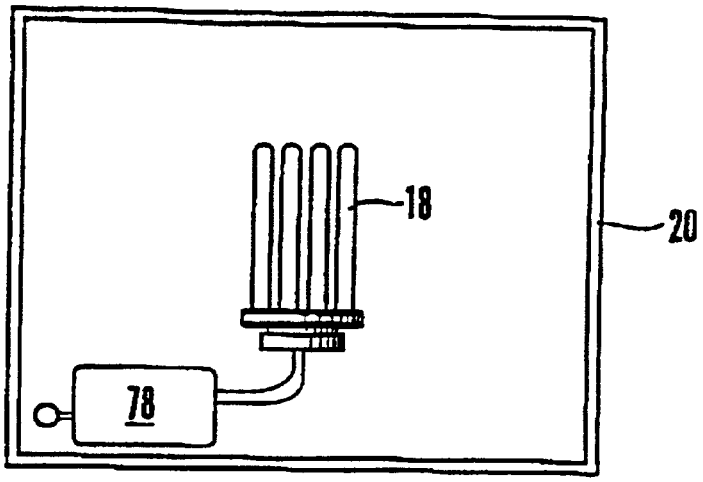
FIG. 7 is a front elevation view showing a light source located within a surrounding light box container in accordance with the present invention.
Figure 8:
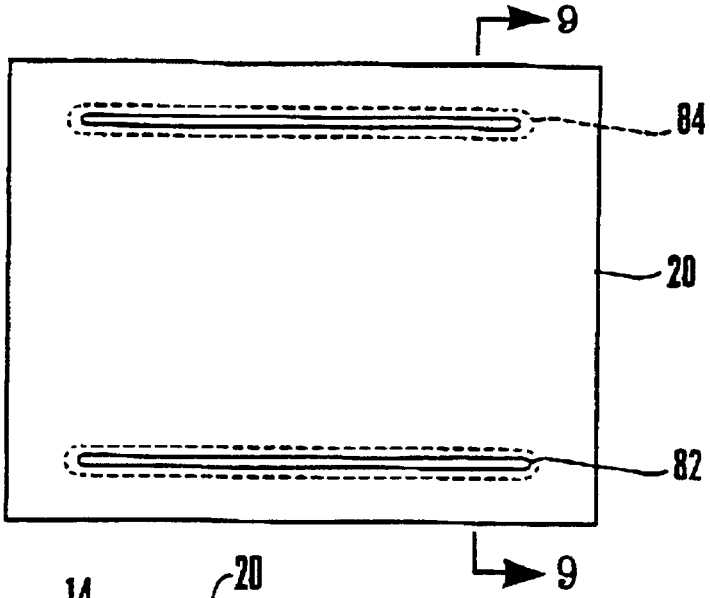
FIG. 8 is a rear elevation view showing ventilation slots located in a light box container in accordance with the present invention.

Alternatively, for reasons of cost and production efficiency, as is shown in FIG. 7, the display housing 20 can be the result of an injected molded of ABS plastic. Also, the light source 18 can be a new lighting technology, and the presently preferred light is a Linear Quad, model FQL28 EX made by Panasonic, which requires use of a ballast 78. With any light, heat is given off, and to minimize the adverse impact of this heat, FIG. 8 shows a pair of ventilation slots 82. To limit the amount of light escaping through the slots 82, each are formed in the rear panel of the display housing 20 in a manner that forms a convex passageway 84.

Figure 9:
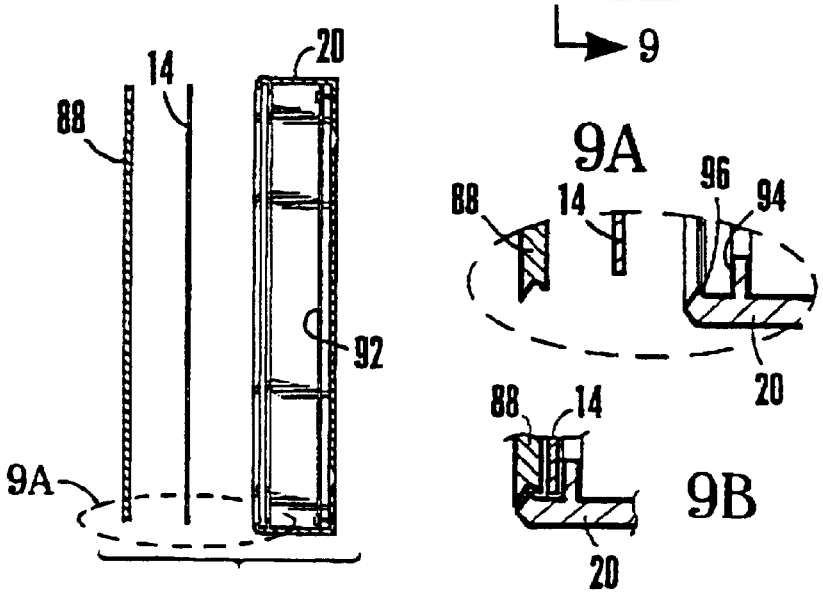
FIG. 9 is a side elevation view, in cross-section taken along line 9—9 of FIG. 8, showing the manner in which the image surface and overlying protective surface are received within a light box in accordance with the present invention.

When utilizing the inject-molded housing 20, it is presently conceived that the reflective panel 14 will be received within the outer periphery of the front opening formed in the display housing 20. As is shown in FIG. 9, a protective acrylic cover 88 is received over the reflective panel 14 FIG. 9 also illustrates the optional use of a rear reflector panel 92. Although not shown in FIG. 9, the light source 18 is preferably attached to the reflective panel 92, which not only assists in the assembly process, but also provides a reflecting surface, minimizing the generation of "hot spots".

FIG. 9A illustrates one possible way to attach the protective cover 88 and the reflective panel 14 to the display housing 20. A receiving shoulder 94 is formed about the outer periphery of the display housing 20 with a camming surface 96 formed immediately adjacent the outer opening of the display housing 20. As is also illustrated in FIG. 9B, upon insertion the reflective panel 14 lies adjacent the receiving shoulder 94. The protective cover 88 is then received within the space remaining between the camming surface 96 and the reflective panel. The plastic material used in the mold is sufficiently resilient that it provides a biasing force against the protective cover 88, holding both in frictional engagement within the display housing 20.

For reasons of cost, weight, and breakage susceptibility, the base layer 42 is preferably acrylic having a thickness of ⅛". When such material is utilized, the reflective layer 46 consists of a mirrored film covered by a protective paint layer. A $CO_2$ laser unit such as a 25-watt unit manufactured by Universal Laser Systems of Scottsdale, Ariz., is presently preferred to inscribe an image in the reflective layer 46.

An ink jet printer such as an Epson 3000 (Epson American, Inc., Torrance, Calif.) is likewise preferred for forming an image on photo-quality banner paper (also supplied by Epson). The positioning of both the positive image 48 and the graphics image 58 is preferably accomplished based upon a graphics file generated using any one of a number of graphics software programs, with Corel 8 (Corel Corporation) presently preferred.

Upon removal of the reflective surface using the laser unit, a surface "cloudiness" remains that impairs the quality of light transmission through the base layer. The application of the clear coating layer 52 addresses this problem, and results in the unimpaired visual transmission of the graphics image 58 through the base layer 42. A number of coating materials are acceptable to form such a layer, including clear urethane coatings. Presently, Optical Coat #702 supplied by American Adhesive Technologies, Inc., of Dracut, Mass., is preferred. Curing of this clear coating is accomplished quickly by UV light energy, preferably by conveying the coated mirror through a UV curing machine having high-intensity UV lights and a conveyer system.

After curing of the optical coat, an optical adhesive is used to adhere the printed-paper graphics layer 56 to the coated mirror surface. An optically clear laminating adhesive such as Product No. 8141 of 3M Company (Minneapolis, Minn.) is presently preferred. It is provided in 1-ml sheets between two protective surfaces of contact paper. Prior to application, one of the contact paper sheets is removed, the adhesive layer is brought into contact with either the paper or coated mirror, and the adhesive is then securely pressed against the surface to which it is being attached. The other contact paper layer is then removed, and is attached to the remaining surface to be attached.

In a presently preferred method, the adhesive layer is first attached to the coated mirror, with the paper graphics layer placed on a vacuum table to assure complete flatness and assist in its alignment prior to attachment of the paper layer to the mirror. A pressure roller is then used to remove any air bubbles that may have been created when mating the paper to the adhesive layer.

My invention has been disclosed in terms of a preferred embodiment thereof, which provides an improved reflective display that is of great novelty lo and utility. Various changes, modifications, and alterations in the teachings of the present invention may be contemplated by those skilled in the art without departing from the intended spirit and scope thereof. It is intended that the present invention encompass such changes and modifications.

I claim:

1. A reflective panel comprising:

a substantially transparent base panel;

a reflective layer attached to said transparent base panel, a selected portion of said reflective layer removed to form a graphic opening, said reflective layer including more than one of said graphical openings;

a carrier layer having a graphical image formed thereon attached to said reflective layer, said graphical image and said graphic opening in registration with one another; and an optical laminate layer interleaved between and attached to both said reflective layer and said carrier layer, wherein said base panel is a panel of acrylic plastic and said reflective layer is a mirrored surface formed thereon.

2. A reflective panel according to claim 1, wherein said reflective layer includes more than one of said graphical openings and wherein said carrier layer has more than one graphical image formed thereon, each of said more than one graphical image is in registration with a separate, specific one of said more than one graphical openings.

3. A reflective panel according to claim 2, wherein said carrier layer is a sheet of paper and said graphical image is a quasi-die sublimation image.

4. A reflective panel according to claim 2, and further comprising:

a light box having a front face on which is mounted said substantially transparent base panel with said attached reflective layer and said carrier layer, said light box and said base panel defining an interior space; and a light source attached to said light box and located within said interior space.

5. A reflective panel according to claim 2, wherein said reflective layer is an optically active surface.

6. A reflective panel according to claim 5, wherein said reflective layer is a holographic reflective surface.

7. A reflective panel comprising:

a substantially transparent base layer having an optically active surface, said optically active surface having at least one graphic opening formed therein by laser a graphics layer attached to said optically active surface, said graphics layer having at least one graphic image formed thereon at a location and of a size such that each of said at least one graphic image precisely registers with a specific one of said at least one graphic opening; and an optical laminate received between and attached to both said optically active surface and to said graphics layer, wherein said graphics layer is a piece of paper and said at least one image is a digital image, whereby control of the laser etching on said optically active surface and placement and formation of the at least one graphic image on said graphic layer utilizes a same set of information.

8. A reflective panel comprising:

a substantially transparent base panel;

a reflective layer attached to said transparent base panel, a selected portion of said reflective layer removed to form a graphic opening;

a carrier layer having a graphical image formed thereon attached to said reflective layer, said graphical image and said graphic opening in registration with one another; and an optical laminate layer interleaved between and attached to both said reflective layer and said carrier layer.

9. A reflective panel for mounting in a light box, comprising:

a substantially transparent base layer having an optically active surface, said optically active surface having at least one graphic opening formed therein by laser etching;

a graphics layer attached to said optically active surface, said graphics layer having at least one graphic image formed thereon at a location and of a size such that each of said at least one graphic image precisely registers with a specific one of said at least one graphic opening; and an optical laminate received between and attached to both said optically active surface and to said graphics layer, whereby control of the laser etching on said optically active surface and placement and formation of the at least one graphic image on said graphic layer utilizes a same set of information.

* * * * *